United States Patent [19]

Mays

[11] Patent Number: 4,574,969

[45] Date of Patent: Mar. 11, 1986

[54] COLLAPSIBLE PAIL

[76] Inventor: Ralph E. Mays, 22903 Cerca Dr., Valencia, Calif. 91355

[21] Appl. No.: 677,741

[22] Filed: Dec. 3, 1984

[51] Int. Cl.[4] ..... B65D 6/16; B65D 8/24

[52] U.S. Cl. ..... 220/8; 220/69

[58] Field of Search ..... 220/8, 69

[56] References Cited

U.S. PATENT DOCUMENTS

| | | | |
|---|---|---|---|
| 1,048,411 | 12/1912 | Hutchins | 220/8 |
| 1,464,548 | 8/1923 | Stephens | 220/8 |
| 1,724,743 | 8/1929 | Allen | 220/8 |
| 2,813,509 | 11/1957 | Bruno | 220/69 |
| 2,834,502 | 5/1958 | Trojan | 220/8 |
| 3,107,028 | 10/1963 | Roberts | 220/69 |

FOREIGN PATENT DOCUMENTS

| | | | |
|---|---|---|---|
| 455989 | 3/1950 | Italy | 220/8 |

*Primary Examiner*—George E. Lowrance
*Attorney, Agent, or Firm*—Roger A. Marrs

[57] ABSTRACT

A pail is disclosed herein having a plurality of tapered sections coaxially disposed with respect to each other so that the lower portion of one section binds with the upper portion of an adjacent section to provide a maximum volume container. Sealing devices are interposed between the binding or frictional coupling of the sections which is releasable so that the sections may collapse about themselves to provide a nestable, low profile storage configuration. The lowermost section of the plurality has a flanged bottom of greater dimension than the dimension of the other sections constituting a stop or limit member to retain the sections together as a unit.

1 Claim, 4 Drawing Figures

COLLAPSIBLE PAIL

BACKGROUND OF THE INVENTION

1. Field of the Invention

The present invention relates to collapsible containers and, more particularly, to a novel collapsible pail which in its extended position has a maximum volume capacity and in its storage position as collapsed presents a reduced volume and profile so that the unit can be stored in a small space.

2. Brief Description of the Prior Art

In the past, pails, buckets, baskets and the like normally use a continuous fixed sidewall which will not fold or collapse so that the sides of the bucket or basket cannot be reduced from its maximum size to a lower profile or volume such as for storage purposes. In an attempt to collapse a bucket or pail when not in use, some pails include sidewalls which are of various tapers or dimensions so that they may be nested inside one another and, when extended, overlapping ridges or flanges engage so as to maintain the sections in an operable condition. Then, when the unit is to be stored, the sections are collapsed upon one another to reduce the overall dimension.

Difficulties and problems have been encountered when employing such prior collapsible containers which stem largely from the fact that when extended, liquids tend to leak between the adjacent wall surfaces of the sections so that it is difficult to carry liquids in the container without spilling, seepage or draining. Also, when inverted flanges or beads are employed to engage adjacent portions of sections when the sections are in the extended position, the various sections will only remain in the extended position when a load is placed on the handle attached to the uppermost section of the plurality. As soon as the container is placed on the ground and the load is taken off of the handle, the uppermost sections of the container will collapse due to gravitational force and contents of the container will spill. Still further problems reside in a provision for maintaining all of the sections in the container as a single unitized article. For example, in some instances when the sections are collapsed, the sections are readily separated from one another and it is difficult to hold the sections together as a unit. In other words, no limit or stop means is provided for preventing disassembly of the plurality of sections from one another in either the extended or collapsed position.

Therefore, a long standing need has existed to provide a novel collapsible container which is of a unitary construction in either the extended or collapsed position and which will readily seal between adjacent sections when in the extended position. Also, means should be provided for releasably holding the plurality of sections together in the extended position and yet prevent the flow of liquid between the adjacent sections without relying upon an applied load to the extended sections.

SUMMARY OF THE INVENTION

Accordingly, the above problems and difficulties are obviated by the present invention which provides a novel collapsible container having a plurality of coaxially disposed sections wherein each section comprises a continuous, tapered sidewall arranged with respect to adjacent sections so that the uppermost portion of a section binds with the lowermost portion of an adjacent section when in the extended position to define a container area of maximum volume. In one form of the invention, means are provided for sealing between the opposing surfaces of section sidewalls which is releasable so that the sections may be repositioned from an extended position to a collapsed position. Limit means are provided on the lowermost section of the plurality for preventing disassembly of other sections so that a unitized container is produced.

Therefore, it is among the primary objects of the present invention to provide a novel collapsible container having multiple tapered nesting sections which, when drawn upward, engage opposing surface areas along their adjacent edge marginal regions and are frictionally self sustaining in their extended positions.

Another object of the present invention is to provide a novel collapsible container such as a basket, pail, bucket or the like which is equipped with sealing means for releasably securing adjacent edge marginal regions of various sections thereof in their extended position and which permits disengagement from frictional engagement so that the various sections can be moved into their collapsed position for convenience of shipment or storage.

Yet another object of the present invention is to provide a novel collapsible container which is readily storable or shipable in a minimum, collapsed size and that is readily extendable into a usable condition having maximum volume for load carrying purposes.

Still a further object of the present invention is to provide a novel collapsible container which may be extended for use as a pail, basket, receptacle or the like which, in a collapsed condition, may be stored or shipped in a minimum amount of space and, when used as a container, may be readily extended to an operative position.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
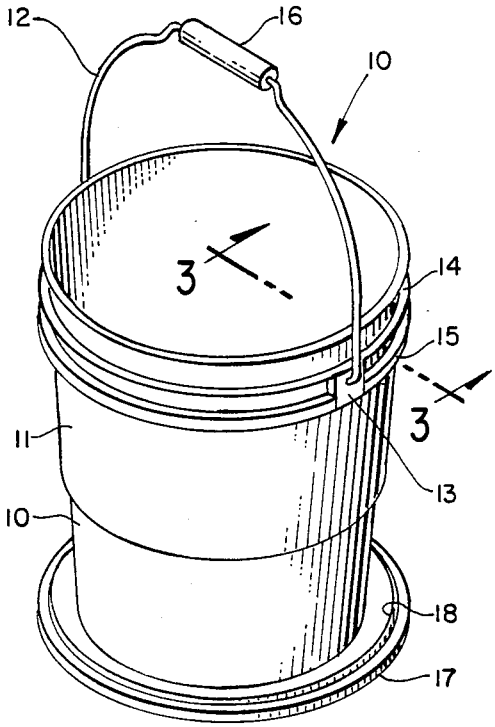
FIG. 1 is a perspective view of the novel collapsible container incorporating the present invention.

Referring to FIG. 1, the novel collapsible container of the present invention is illustrated in the general direction of arrow 10 which includes a plurality of sections such as section 10 and section 11. The sections are coaxially disposed with respect to one another and include a continuous sidewall which is slightly tapered so that the section 11 fits externally about the sidewall of section 10. However, as the lower portion of section 11 merges with the upper portion of section 10, the opposing wall surfaces of the section engage in a frictional fit so that the sections will be maintained in an extended position as illustrated.

Section 11 includes a bale 12 which is pivotally carried at its opposite ends to the section 11 by means of reinforcing blocks such as block 13. Stiffening ridges 14 and 15 are placed about the external surface of section 11 to serve as stiffening members supporting the open end of the section leading into the interior of the container. A handle 16 taking the form of a roller is movably mounted in the center of the bale 12 so that it may be readily grasped by the hand of the user for carrying in the extended position. Also, when it is desired to place the sections in the extended position, the user may tug slightly on handle 16 which will forcibly urge the inside surface of the lower edge marginal region of section 11 to frictionally engage and bind with the upper edge marginal region of the section 10. To disengage or release the sections, a slight tap or blow is directed along the upper edge of the container section 11 which will drive the section downward over the section 10 so that the sections will nest together. Although only two sections are illustrated, it is to be understood that additional sections may be incorporated depending upon the end use for the container.

In order to prevent the upper section 11 from disassembling from its coaxial relationship with respect to the lower section 10, a limit or stop member 17 is carried at the bottom of section 10 and is of a greater dimension than the dimension of the lower portion of section 11. Therefore, section 11 cannot slip or slide off the top of section 10 due to engagement of the lower portion of section 11 with the upper portion of section 10 and section 11 cannot disengage from the other end of section 10 because of interference with the limit or stop means 17.

In one form of the invention, the limit or stop means 17 may take the form of a lid which was previously used for the container and the means may include at least one circular groove 18 which, when employed as a lid, will interface and receive the edge of the container section 11. However, when the lid is used as a stop means, the lower section 10 is centered and adhesively or snap-locked into engagement with the lid.

Figure 2:
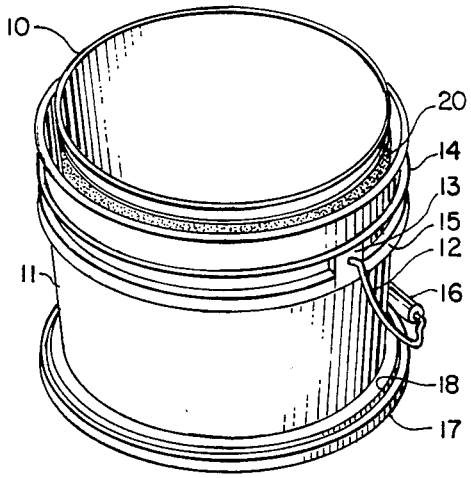
FIG. 2 is a view similar to the view of FIG. 1 illustrating the container in a collapsed position.

Referring now in detail to FIG. 2, it can be seen that the container is in its collapsed position as opposed to the extended position as shown in FIG. 1. In the collapsed position, the assembly is unitized since the outer or upper section 11 cannot be disengaged from the inner section or bottom section 10. Therefore, the height of the total assembly is greatly reduced from the extended position and a unitized assembly is maintained because of the dimensions upper portion of section 11 being of greater dimension or diameter than the upper portion of section 10. Furthermore, the stop means 17 prevents the upper section 11 from disengaging therewith. Also, it can be seen that the height of section 11 is shorter or of lesser dimension than the height of the inner or bottom section 10.

Figure 3:
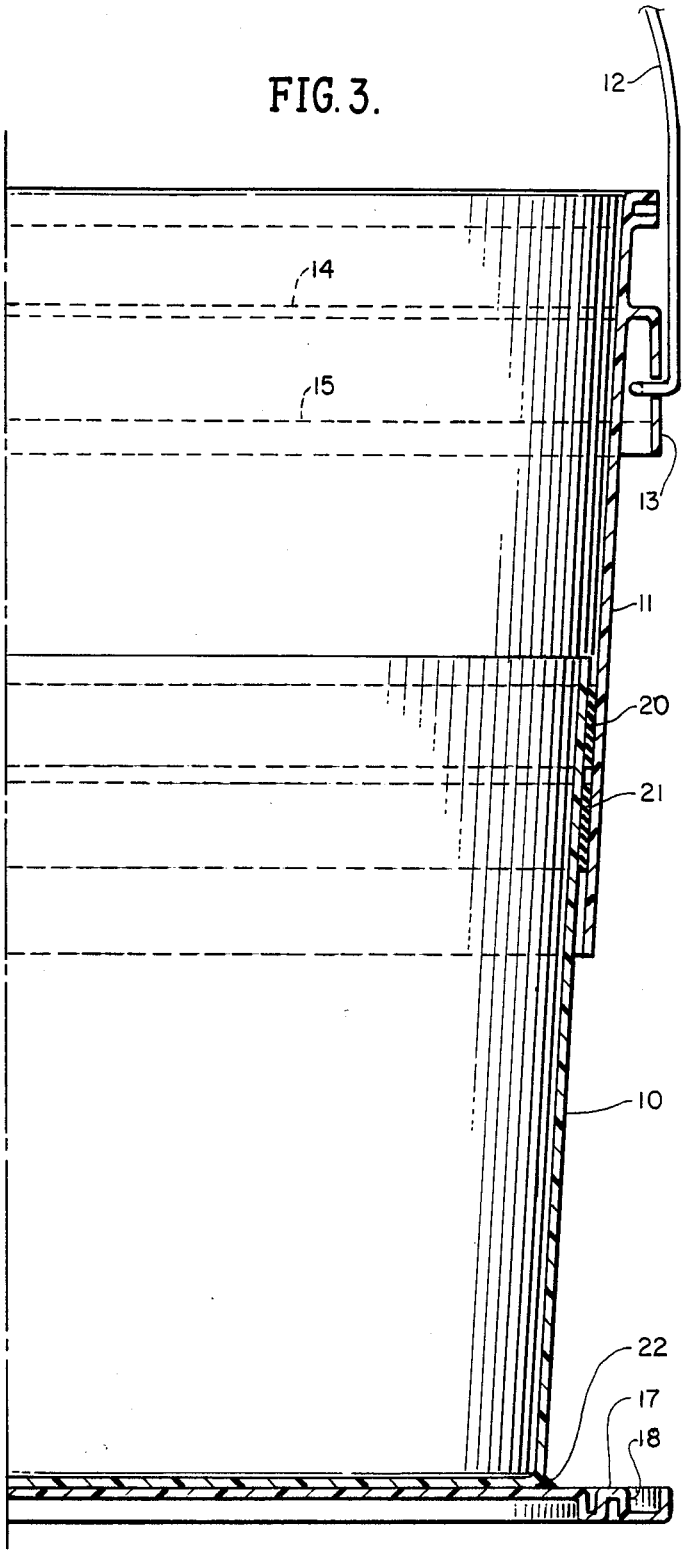
FIG. 3 is an enlarged longitudinal cross-sectional view of the novel collapsible container illustrated in its extended position as taken in the direction of arrows 3—3 of FIG. 1.

Referring now in detail to FIG. 3, it can be seen that the collapsible container of the present invention includes a sealing means disposed between the opposing surfaces of the upper portion of section 10 and the lower portion of section 11. In one embodiment, the sealing means takes the form of adhesive strips or tapes 20 and 21 which are arranged in a band or band-like fashion around the upper portion of the inner or bottom section 10 in fixed spaced apart relationship. The tapes are preferably adhesively attached to the external surface of section 10 and present a smooth cushioned or resilient surface to the inside surface of the continuous sidewall of the lower portion of section 11. In this manner, frictional engagement will hold the two sections together when a load is placed on the handle 16 and when it is desired to release connection, the upper section may be forced downwardly to separate the sections. The sealing means 20 and 21 not only insures a good bind between the two sections but forms a seal to prevent liquid from seeping or draining therebetween.

It can also be seen in FIG. 3 that the lid 17 is attached to the bottom of section 10 by a suitable adhesive or binder 22. However, in another form of the invention, the section 10 may be provided with a downwardly depending flange or foot such as indicated by numeral 23 in FIG. 4 which is snap-locked into engagement with a receptacle or groove 24 provided in the stop means 17. Construction in this latter manner provides the user with the option of using the stop means as a lid or as a stop as desired.

Figure 4:
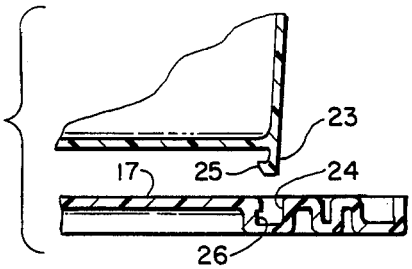
FIG. 4 is a fragmentary exploded sectional view of another embodiment of the present invention illustrating a detachable limit stop.

Referring in detail to FIG. 4, it can be seen that the foot or circular rim 23 may include a detent 25 which may insertably engage into an aperture 26. Inasmuch as the components parts are composed of a plastic or plastic-like material, a snap fit is easily achieved.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A collapsible pail comprising the combination of:

a plurality of tapered sections coaxially disposed with respect to each other;

each of said pail sections having an upper portion and a lower portion arranged so that the lower portion of one section binds with the upper portion of another section so as to provide a maximum volume container;

sealing means disposed between adjacent and binding portions of said sections providing releasable frictional engagement therebetween;

said sections characterized as being nestable in one condition providing a low profile for storage purposes and extendable to another condition constituting said maximum volume container;

said lower portion of said other section includes a circular flange serving as a stop means limiting disassembly of said sections from said coaxial relationship and from each other;

said sealing means comprising a pair of annular spaced apart tapes of resilient composition characterized as being compressible to effect a waterproof seal between said adjacent and binding portions of said sections;

said tapered upper portion of said one section cooperates with said flange of said lower portion of said other section to combine said sections as a unit in either of said first and second conditions;

snap-lock means are cooperatively disposed between said lower portion of said other section and said flange whereby said flange is removably coupled to said lower portion of said other section;

said flange is removably connectable to said upper portion of one section constituting a lid therefor in either one of said aforementioned conditions; and said flanged bottom of said other section is of greater dimension than the dimension of said other section so as to retain said sections together as a unit.

* * * * *